United States Patent [19]

Gallagher

[11] Patent Number: 4,485,632

[45] Date of Patent: Dec. 4, 1984

[54] CONTROL CIRCUIT FOR AIR CONDITIONING SYSTEMS

[75] Inventor: John B. Gallagher, Greensboro, N.C.

[73] Assignee: Loew's Theatres, Inc., New York, N.Y.

[21] Appl. No.: 486,698

[22] Filed: Apr. 20, 1983

[51] Int. Cl.[3] ..... F25D 17/08

[52] U.S. Cl. ..... 62/179; 165/16; 236/49

[58] Field of Search ..... 165/16; 236/49; 62/179, 62/332

[56] References Cited

U.S. PATENT DOCUMENTS

| | | | |
|---|---|---|---|
| 2,206,445 | 7/1940 | Beeler | 62/129 |
| 3,051,451 | 8/1962 | Bierwirth et al. | 257/274 |
| 3,405,758 | 10/1968 | Walker et al. | 165/16 |
| 3,801,008 | 4/1974 | Wenger | 236/46 |
| 3,927,713 | 12/1975 | Gilles | 165/16 |
| 3,979,922 | 9/1976 | Shavit | 62/97 |
| 4,018,266 | 4/1977 | Kay | 165/12 |
| 4,044,947 | 8/1977 | Spethmann | 236/13 |
| 4,069,030 | 1/1978 | Nickell et al. | 62/176 C |
| 4,142,574 | 3/1979 | Shavit | 165/16 |
| 4,186,564 | 2/1980 | Myers | 62/180 |
| 4,293,027 | 10/1981 | Tepe et al. | 165/12 |
| 4,320,628 | 3/1982 | Okajima | 165/16 X |
| 4,347,712 | 9/1982 | Benton et al. | 62/175 |
| 4,385,503 | 5/1983 | Okura | 165/16 X |
| 4,391,320 | 7/1983 | Inoue et al. | 165/16 X |

*Primary Examiner*—William E. Tapolcai
*Attorney, Agent, or Firm*—Brumbaugh, Graves, Donohue & Raymond

[57] ABSTRACT

In an air conditioning system, the positions of the dampers in the outside air duct and the return air duct are changed periodically during periods of mechanical refrigeration. The temperature of the refrigerated air is sensed and compared with the temperature of the refrigerated air sensed prior to the change in damper positions. The positions of the dampers are controlled in accordance with the lowest temperature detected.

9 Claims, 1 Drawing Figure

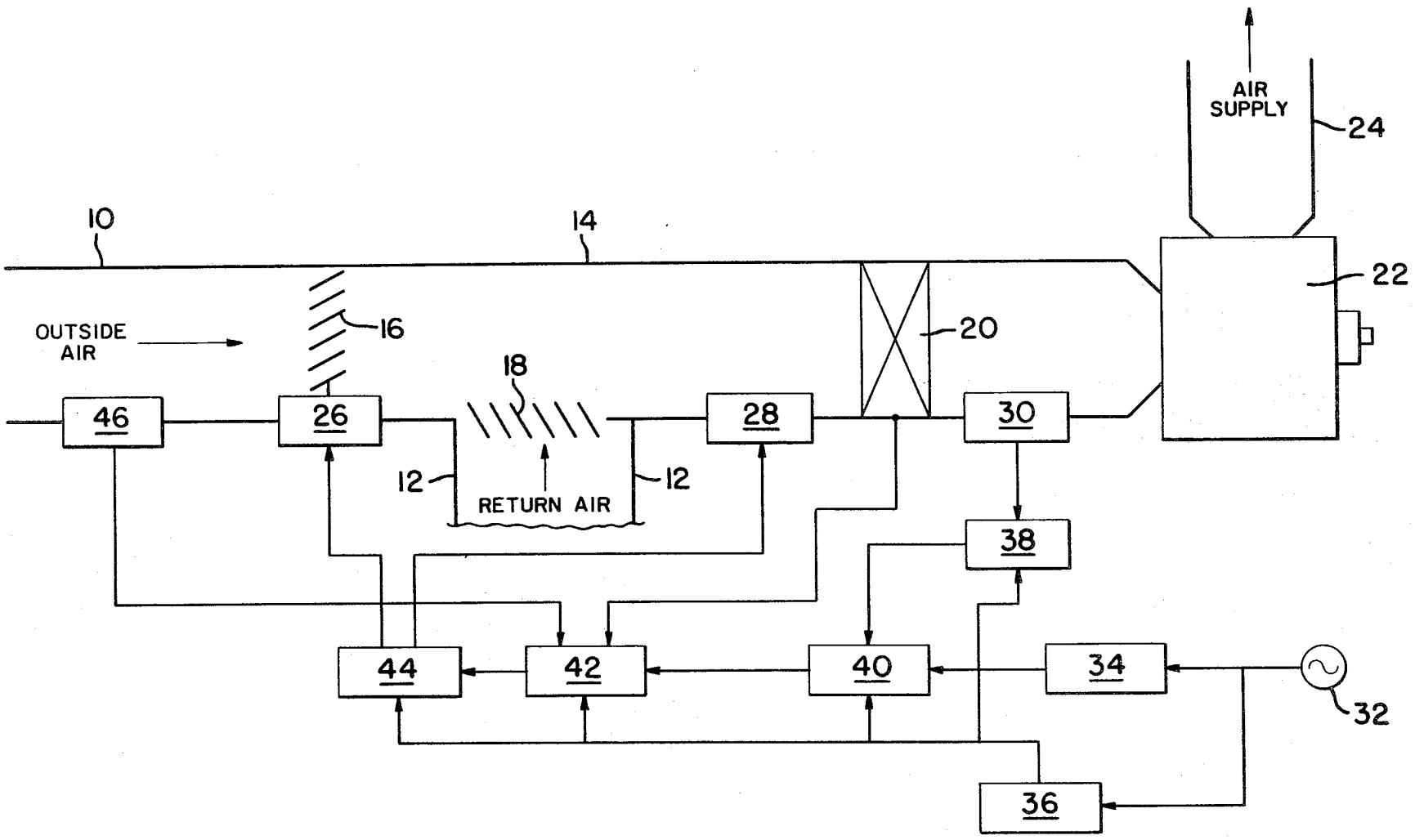
AIR SUPPLY
24
22
32
34
36
30
38
20
40
28
12
14
42
18
RETURN AIR
12
44
16
26
10
OUTSIDE AIR
46

CONTROL CIRCUIT FOR AIR CONDITIONING SYSTEMS

BACKGROUND OF THE INVENTION

This invention relates to industrial and comfort air conditioning systems and, more particularly, to air conditioning systems having controls for automatically operating the dampers in the outside-air duct and the return-air duct.

Typically, air conditioning systems used in manufacturing facilities have the size and capacity to maintain the inside air at a dry bulb temperature of about 75° F. and a relative humidity of about 60%. As shown in standard ASHRAE psychrometric charts, such inside air conditions may be attained by using supply air having a temperature of about 61.5° F. and a relative humidity of typically 95%. Such supply air conditions can be achieved by mixing outside air and return air when the outside conditions or heat content (enthalpy) is below the required supply air. On the other hand, when the outside air conditions or heat content rises above the required supply air conditions or heat content then mechanical refrigeration, or mechanical energy, is required for the cooling medium.

In air conditioning systems, so equipped, dampers control the flow of inside air and outside air to the cooling coil or cooling medium. As between the use of outside air and the return air, it is clearly more energy efficient, during mechanical refrigeration periods, to pass over the cooling coil or cooling medium the air (outside or return) which has the lowest heat content. Control systems have thus been developed to make maximum use of the outside air when its heat content is low and to make maximum use of the return air when its heat content is lower than that of the outside air. One such system is disclosed in U.S. Pat. No. 2,206,445; another is referred to in the background section of U.S. Pat. No. 4,347,712.

SUMMARY OF THE INVENTION

As in the prior art air conditioning control systems, it is an object of the present invention to make maximum use of the source of air which has the lowest heat content to achieve a desired inside temperature during mechanical refrigeration periods.

It is another object of the present invention to make use of the temperature differential between the return air and outside air in an air conditioning system and condition the one which has the lowest heat content.

These and other objects of the present invention are achieved by periodically detecting the temperature of the supply air during refrigeration, changing the damper positions in the outside air and return air ducts, detecting a short time thereafter the temperature of the supply air, comparing the temperatures detected both before and after the change in damper position and controlling the positions of the dampers in accordance with the lowest temperature detected.

BRIEF DESCRIPTION OF THE DRAWING

In the drawing there is shown a schematic diagram of an air conditioning system with a control circuit for positioning the dampers in accordance with the heat content of the outside air and the return air.

DESCRIPTION OF THE PREFERRED EMBODIMENT

In the air conditioning system arranged according to the present invention shown in the drawing, outside air and return air ducts 10 and 12, respectively, are joined to an air conditioning housing 14. The ducts contain dampers 16 and 18 which are operated simultaneously to permit the flow of either outside air or return air, but not both, to the housing 14. In the housing 14, the outside air or the return air, as the case may be, passes through a refrigeration produced cooling medium 20 which may be, for example, a water coil, refrigeration coil, chilled water spray, etc. After the cooling medium 20, the cooled air is blown by a fan 22 into an air supply duct 24.

In order to minimize the heat exchange which occurs during refrigeration of the cooling medium, a control system is provided for controlling the operation of the dampers 16 and 18 and thereby provide for the cooling of the air which has the lowest heat content. The control system includes a pair of relays 26 and 28 coupled to the dampers 16 and 18, respectively, which are alternately energized to open one set of dampers and close the other set of dampers. A temperature sensitive transducer 30, such as a thermocouple or thermistor, is mounted in the housing 10 on the cooling side of the coil 20 and develops an electrical signal having a magnitude which is commensurate with the temperature of the refrigerated supply air.

The control system is enabled by a voltage source 32 that supplies a 120 volt alternating current signal to a timer 34 and a transformer 36. In the transformer 36, the supply voltage is rectified and reduced to about 12 volts. The 12 volt d-c signal is then employed to activate an analog-to-digital converter 38, a comparator 40, an AND gate 42 and a relay 44.

The timer 34 is adjusted to emit periodically, e.g. once an hour, two signals which are separated in time by about two minutes. The first of the emitted signals enables the digital signal stored in the analog-to-digital converter 38 to be stored in the comparator 40. The signal in the converter 38 represents the digital representation of the temperature of the refrigerated air, as sensed by the transducer 30.

With the storage of the digital representation of the temperature of the refrigerated supply air, the comparator 40 generates an enabling signal that is supplied to the AND gate 42. The other input terminals of the AND gate 42 are connected to a thermostat 46 mounted in the outside air duct 10 and a switch that is closed when the refrigeration unit 20 is operating. Ordinarily, the thermostate 46 supplies an enabling signal to the AND gate 42. However, at a predetermined outside air temperature, such as 80° F., the thermostat supplies a signal which disables AND gate 42.

Provided that the thermostat 46 and the refrigeration unit 28 supply enabling signals to the AND gate 42, the gate supplies a d-c voltage signal which changes the state of the relay 44. With the change in state of the relay 44, the states of the relays 26 and 28, respectively, will be changed. The positions of the dampers 16 and 18 change with the change in states of the relays 26 and 28.

The timing signal emitted by the timer 34 about two minutes after the first timing signal is generated permits the gating of a second temperature representative digital signal to the comparator 40. This second digital signal represents the temperature of the refrigerated air after the change in the positions of the dampers 16 and 18. In the comparator 40, the digital signal representative of the temperature of the refrigerated air prior to the change in positions of the dampers 16 and 18 is compared with the digital signal which is representative of the temperature of the refrigerated air after the change in damper positions. If the temperature of the refrigerated air after the change in damper positions is lower than the temperature before the change in damper positions, no output is generated by the comparator 40. If, however, the temperature sensed after the change in positions is greater than the temperature sensed before the change, the comparator generates a further enabling signal that, through the AND gate 42, changes the state of the relay 44. The change in state in the relay 44 causes a change in state in the relays 26 and 28, and, accordingly, the dampers 16 and 18 are returned to their original positions.

In operation, thus, when the outside air damper 16 is open, the return air damper 18 is closed. The positions will be changed periodically under the indirect control of the timer 34. If an increase in temperature is sensed by the transducer 30 after the change, the dampers will be returned immediately to their original positions. If a decrease or no change in the temperature of the conditioned air occurs, the dampers will remain in their switched positions.

While the invention has been particularly shown and described with reference to a preferred embodiment thereof, it will be understood by those skilled in the art that various changes in form and details may be made therein without departing from the spirit and scope of the invention.

I claim:

1. In an air conditioning system wherein outside air or return air is conditioned to achieve a predetermined inside temperature, the improvement comprising means for periodically conditioning in sequence the outside air and the return air, means for sensing the temperatures of the conditioned outside air and the conditioned return air, comparator means responsive to the sensing means for determining the difference in heat content of the conditioned outside air and the conditioned return air, and means responsive to said determination for enabling until the next periodic conditioning of both the outside air and the return air the passage into the air conditioning system of whichever air will achieve the predetermined inside temperature most efficiently.

2. The improvement according to claim 1, wherein the sensing means comprises a transducer responsive to the temperature of the conditioned outside air and the conditioned return air for developing electrical signals, the magnitudes of which correspond to the temperatures of the conditioned outside air and the conditioned return air.

3. The improvement according to claim 2, further comprising converter means for converting the developed electrical signals into digital signals and wherein the comparator means includes means for comparing said digital signals and generating an output signal whenever the magnitude of the second in time of the transducer developed signals exceeds the magnitude of the first in time of the transducer developed signals.

4. The improvement according to claim 1 or 3, further comprising first damper means for controlling the flow of outside air into the air conditioning system, second damper means for controlling the flow of return air into the air conditioning system and relay means operatively coupled to the first and second damper means for operating them simultaneously, one to the open position, the other to the closed position.

5. The improvement according to claim 4, further comprising timer means coupled to the comparator means for periodically generating a pair of spaced timing signals and wherein the comparator means responds to the first of the timing signals to energize the relay means.

6. The improvement according to claim 5, wherein the comparator means also responds to the first of the timing signals to store the digital signal representative of the temperature of the conditioned air at the time the first of the timing signals is generated and wherein the comparator means responds to the second of the timing signals to store the digital signal representative of the temperature of the conditioned air after the change in state of the first and second damper means.

7. The improvement according to claim 6, wherein the comparator means includes further means for comparing the stored digital signals and energizing the relay means when the magnitude of the digital signal representative of the temperature of the conditioned air after the change in state of the first and second damper means is greater than the digital signal representative of the temperature of the conditioned air prior to the change in state of the first and second damper means.

8. The improvement according to claim 7, further comprising means responsive to the temperature of the outside air for disabling the comparator means when the temperature exceeds a certain level.

9. The improvement according to claim 8, further comprising means for enabling the comparator means during the periods when the outside air or the return air is being conditioned.

* * * * *